United States Patent [19]

Hashimoto et al.

[11] 4,389,121

[45] Jun. 21, 1983

[54] SPEECH SYNTHESIZER TIMEPIECE WITH ALARM FUNCTION

[75] Inventors: Shintaro Hashimoto, Ikoma; Akitaka Morita, Nara; Hiroshi Tsuda, Uji, all of Japan

[73] Assignee: Sharp Kabushiki Kaisha, Osaka, Japan

[21] Appl. No.: 234,862

[22] Filed: Feb. 13, 1981

[30] Foreign Application Priority Data

Feb. 15, 1980 [JP] Japan ..... 55-18298
Feb. 22, 1980 [JP] Japan ..... 55-21804

[51] Int. Cl.[3] ..... G04B 21/08; G04B 23/02
[52] U.S. Cl. ..... 368/63; 368/73
[58] Field of Search ..... 368/63, 72–75, 368/250, 251, 710; 179/1 SA, 1 SM

[56] References Cited

U.S. PATENT DOCUMENTS 3,919,834 11/1975 Murakami et al. ..... 368/63
3,998,045 12/1976 Lester ..... 368/63
4,266,096 2/1981 Inoue et al. ..... 368/63
4,279,030 7/1981 Masuzawa et al. ..... 368/63

FOREIGN PATENT DOCUMENTS 2911853 10/1979 Fed. Rep. of Germany ..... 368/63
54-123069 7/1979 Japan ..... 368/63
55-70783 5/1980 Japan ..... 368/63

*Primary Examiner*—Vit W. Miska
*Attorney, Agent, or Firm*—Birch, Stewart, Kolasch and Birch

[57] ABSTRACT

A timepiece is disclosed which is capable of delivering an alarm sound or message when an alarm time setting is reached. The timepiece further includes an output mode selector for selecting a sound mode for delivering the alarm sound or alarm message and a silence mode for inhibiting the delivery of the alarm sound or message. Also included is an alarm time announcement output circuit responsive to the output mode selector for delivering an audible indication of an alarm setting time in the form of synthesized human voices when the selector is switched to the sound mode.

4 Claims, 7 Drawing Figures

SPEECH SYNTHESIZER TIMEPIECE WITH ALARM FUNCTION

BACKGROUND OF THE INVENTION

This invention relates to a speech synthesizer timepiece with alarm function which displays a time setting in a visual or an audible form when the time setting is reached. More particularly, the invention relates to a talking timepiece which is capable of providing an audible representation of a time setting already registered in the timepiece when the alarm mode is switched from the silence mode to the sound mode.

In the past, the applicant of this application proposed a talking timepiece with a variety of functions. To provide alarm function, such timepiece is adapted to deliver an alarm sound or message when an alarm setting time is reached. However, it is often necessary to confirm what time the operator has set. In the case of an alarm timepiece with a visual display, two lines of display are needed with one displaying real time and the other displaying an alarm setting.

OBJECTS AND SUMMARY OF THE INVENTION

With the foregoing in mind, it is an object of the present invention to provide an alarm timepiece with capabilities of providing an audible indication of an alarm setting time in the form of synthesized human voices whenever necessary.

In accordance with a preferred embodiment of the present invention, there is provided a timepiece capable of delivering an alarm sound or message when an alarm time setting is reached. The timepiece further comprises an output mode selector means for selecting a sound mode for deliverying the alarm sound or alarm message and a silence mode for inhibiting the delivery of the alarm sound or message and an alarm time announcement means responsive to said output mode selector means for delivering an audible indication of an alarm setting time in the form of synthesized human voices when the selector means is switched from the silence mode to the sound mode. In another preferred form of the present invention, an additional message, for example, "Good morning, this is Sharp's talking timepiece" may be delivered as well as the time setting when the time setting is reached.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
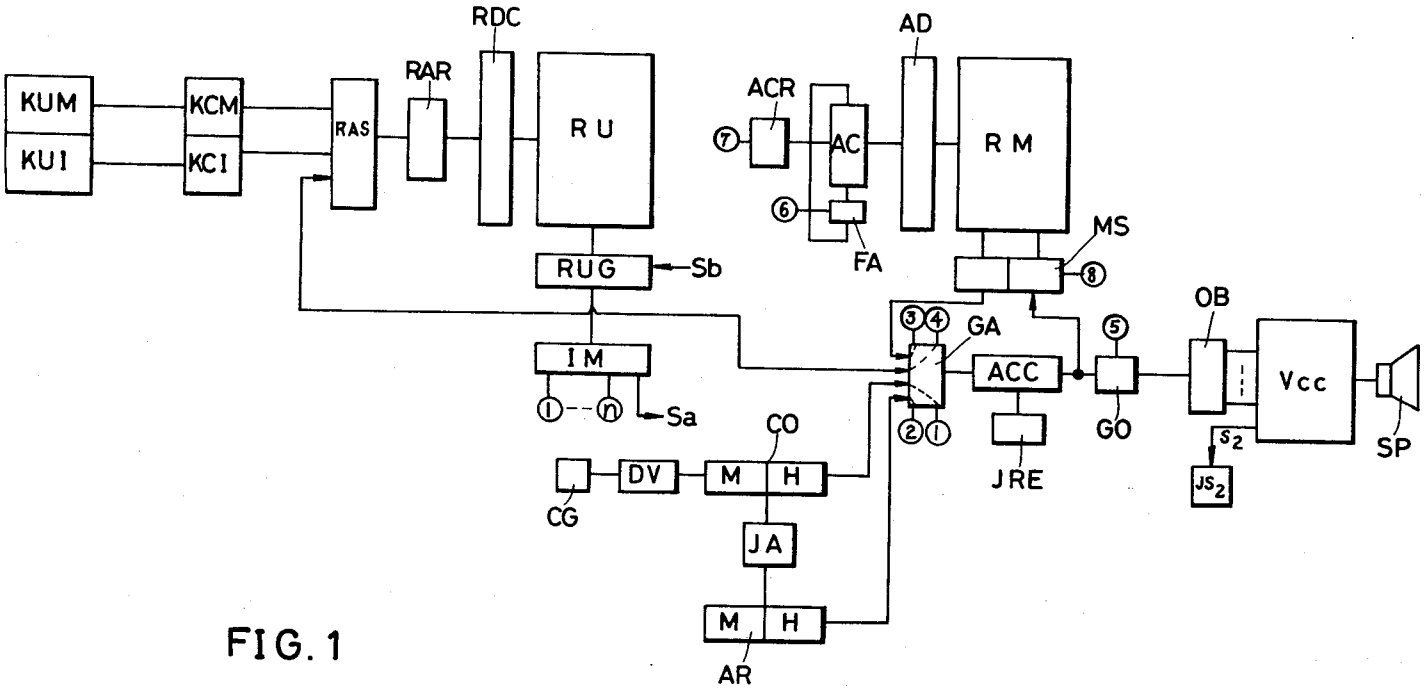
FIG. 1 is a schematic block diagram of an embodiment of the present invention.

In accordance with an embodiment of the present invention, a speech synthesizer timepiece is adapted to deliver a message "It's now XXX (in hours) XXX (in minutes)", followed by a melody, when an alarm time setting is reached. Referring now to FIG. 1 showing a block diagram of the one embodiment of the present invention, there is shown a mode selector switch KUM, a time setting and time announcement key unit KUI and a pair of input decoders KCM and KCI. A program memory (ready only memory) RU includes an address decision circuit RAS, an address register RAR and an address decoder RDC. An instruction selector RUG operatively associated with RU selects program steps based on signals $S_b$ from respective comparators. An instruction decoder IM provides a string of microinstructions 1 , 2 , . . . n to various components and the control signals $S_b$ to the respective comparators.

There is further provided a clock generator CG, a frequency divider DV, a timekeeping register CO comprising a minutes section M and a hours section H for storing updated time of the day, an alarm register AR comprising a minutes section M and a hours section H for storing an alarm time setting, and an agreement detector JA for sensing whether CO and AR agree.

A memory unit RM of typically a well-known random access memory has its peripheral components an address decoder AD, an address counter AC, an adder FA for incrementing the count of AC and a reset circuit ACR for initializing the count of AC. RM also has an input/output control MS. An accumulator ACC has an input control GA and a decision circuit JRE for deciding whether data transmitted to ACC is an end code EC described hereafter.

A voice output control VCC functions to release from a loud speaker SP voices in correspondence with codes transmitted to an output buffer OB via a logic gate GO. A decision circuit $JS_2$ senses a sound output end signal $S_2$ from VCC.

Figure 2:
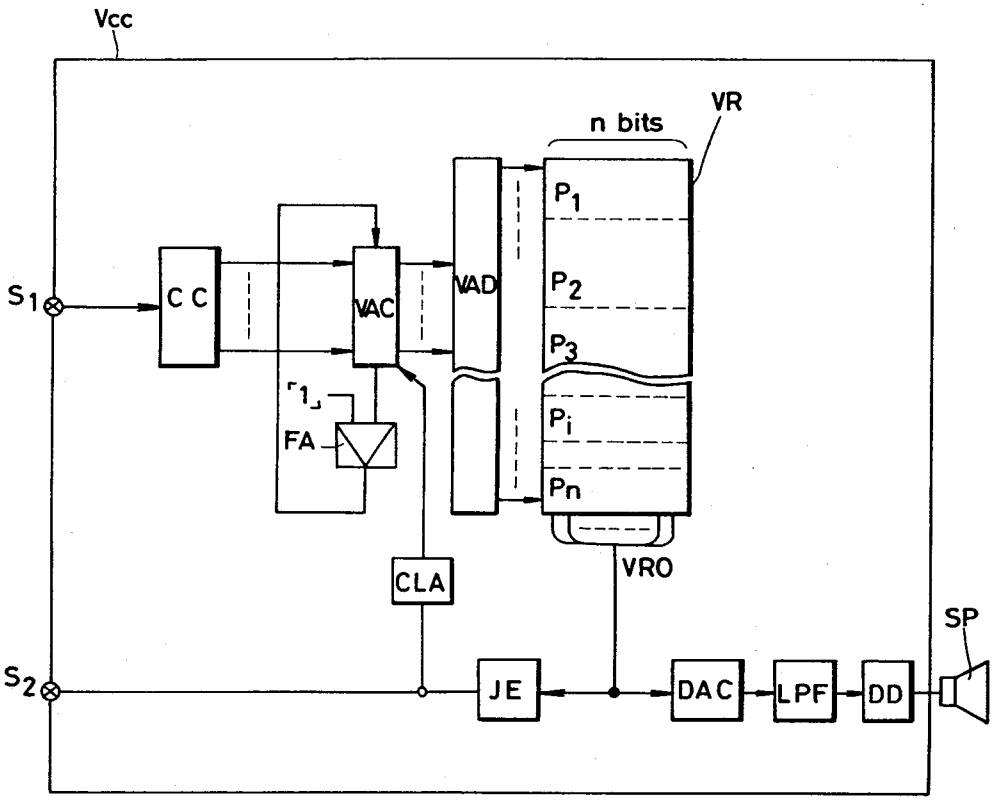
FIG. 2 is a block diagram showing a voice output control VCC of FIG. 1 in more detail.

Details of the voice output control VCC are illustrated in FIG. 2. A memory unit VR typically comprises a read only memory for storing sound-related data, an address counter VAC and an address decoder VAD. A reset circuit CLA resets the address counter VAC and does not specify any address of the memory unit VR when no audible output is necessary. An adder FA is used to increment the address of the address counter VAC by one and automatically executes an addition of VAC+1=VAC at a given sampling frequency, when an initial address of a particular sound region $P_i$(i=1, 2 . . . n) is established in the address counter VAC, and helps fetch sound synthesis data from that particular sound region $P_i$.

A code converter CC receives sound region specifying signals $S_1$ supplied via the output buffer OB and converts them into codes necessary for establishing the initial address of the particular sound region $P_i$ in the address counter VAC for the delivery of desired sounds or synthesized human voices. An END code detector JE is adapted to sense an END code which is usually placed at the end of sequential steps in the particular sound region $P_i$ and provide its output which in turn makes the reset circuit CLA operative and resets the address counter VAC. This output is supplied as the signal $S_2$ to $JS_2$ of FIG. 1.

There is further provided a digital-to-analog converter DAC, a low pass filter LPF, a speaker driver DD and the loud speaker SP.

Figure 3:
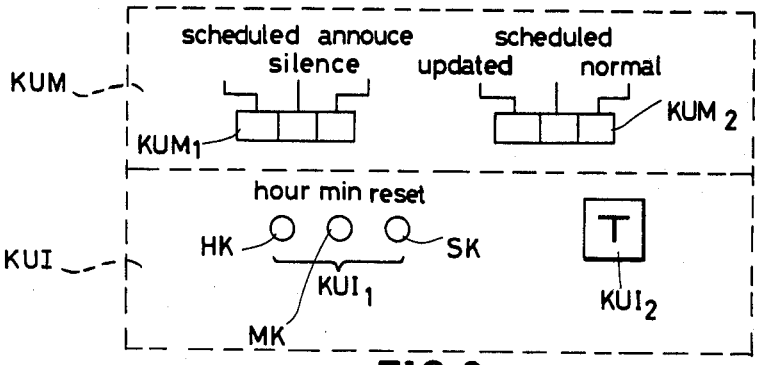
FIG. 3 is a detailed view of a mode selector KUM and a time setting and time announcement key unit KUI, as seen in FIG. 1.

Specific examples of input sections of KUM and KUI of FIG. 1 are shown in FIG. 3 in more detail. An output mode selector slide switch KUM 1 in the "scheduled" position enables the timepiece to deliver the alarm message indicative of the already introduced alarm time setting, "XXX (in hours) XXX (in minutes)" (its Japanese version is "goyotei XXX ji XXX pun") in the form of synthesized human voices. In this position the visual display continues displaying updated time of the day. Thereafter, when the alarm time setting is reached, the audible alarm message "It's now XXX (in hours) XXX (in minutes)" is output followed by a melody. Furthermore, with the mode selector switch KUM 1 in the "announcement" position, the timepiece delivers time announcements at every hour or every half hour, for example, "It's XXX o'clock", followed by time signals. In addition, when the mode selector switch is in the "silence" position, no audible output is delivered but a visual display of the alarm time setting is instead outputted. No time announcements are effected with the mode selector in the "scheduled" position. Therefore, if the alarm setting is to be used as a morning call, the operator can sleep without being disturbed by time announcements.

A time setting mode slide switch KUM 2 is a selector switch having an "updated" position for setting a correct time and a "scheduled" position for setting a scheduled alarm time as well as a normal position.

Time setting keys KUI 1 comprise a hour key HK for incrementing time information in hours whenever depressed and a minute key MK for incremeting time information in minutes whenever depressed. Current time or scheduled time is stored set upon depression of a setting key SK. An updated time announcement key KUI 2(T) enables the timepiece to announce the updated time of the day, for example, "It is one o'clock".

Figure 4:
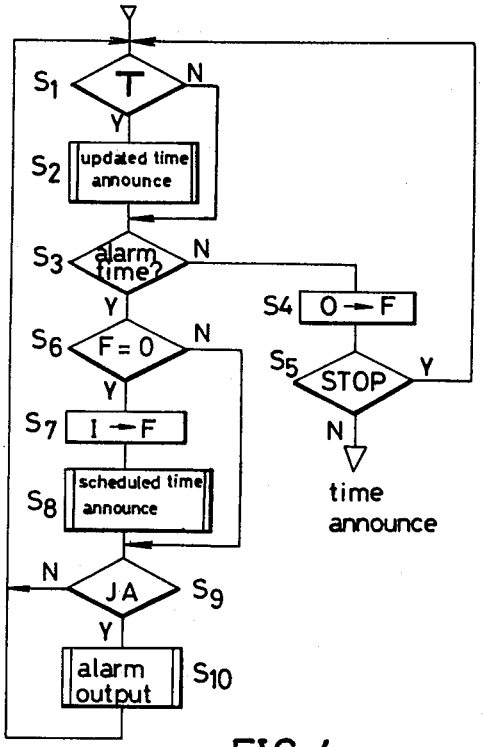
FIGS. 4 and 5 are flow charts for explanation of operation of the embodiment of FIG. 1.

Operation of the timepiece embodying the present invention will be discussed with reference to a flow chart of FIG. 4. Upon actuation of the current time announcement key KUI 2(T) the current time is announced in the form of synthesized human voices by means of $S_2$. When the output mode selector slide switch KUM 1 is in any position except the "scheduled" position, a flat F is reset with $S_4$. It is obvious that the flag F may be set up in a specific memory location within the memory RM. With the output mode selector slide switch KUM 1 in the "silence" position, the timepiece goes back to $S_1$ or announces time every hour or every half hour if the mode selector is in the "announce" position.

When the output mode selector slide switch KUM 1 is in the "scheduled" position, $S_6$ decides if the flag F is reset. F=0 implies that the mode selector switch is switched from the "silence" position or from the announce position to the "scheduled" position. After F is set by $S_7$, $S_8$ achieves announcements of the scheduled alarm time. If the updated time is equal to the scheduled time, then the timepiece goes back to $S_1$. If F is not in the set state, the timepiece proceeds from $S_6$ to $S_9$ with no announcements of the scheduled time.

If the updated time and the scheduled time agree, then $S_{10}$ is carried out so as to perform announcements of alarm time in the form of synthesized human voices. For example, "It's now XXX (in hours) XXX (in minutes)" is delivered and followed by an attractive melody.

Figure 5:
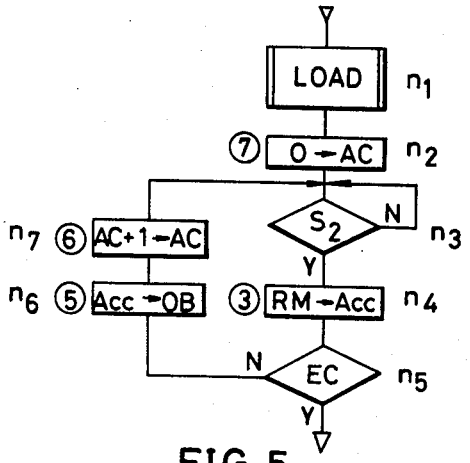

FIG. 5 is a chart showing details of audible output routines $S_2$, $S_8$ and $S_{10}$. In step $n_1$, the memory RM is loaded with codes indicative of words to be audibly delivered. The next succeeding step $n_2$ specifies the leading address of the memory RM and the step $n_3$ decides if the voice output control VCC has developed the audible output end signal $S_2$. If so, $n_4$ transfers the required address of the memory RM to ACC, followed by step $n_5$ deciding whether the contents of ACC are the transfer end code EC. If not, $n_6$ sends the contents of ACC to the output buffer OB and $N_7$ increments the addressing for fetching RM. The timepiece returns to $n_3$ and proceeds with $n_4$ if the output of $S_2$ is sensed.

The above procedure is repeated until all of the word codes in RM are completely transferred in sequence to the voice output control VCC as confirmed by the transfer end code.

Figure 6A:
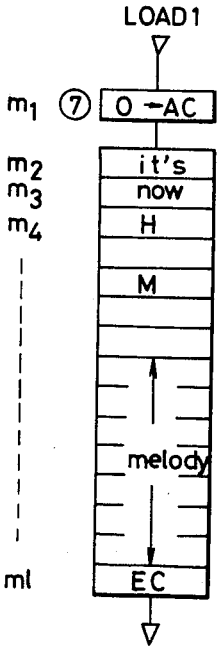
FIGS. 6(A) and 6(B) are views for a load routine shown in FIG. 5.
Figure 6B:
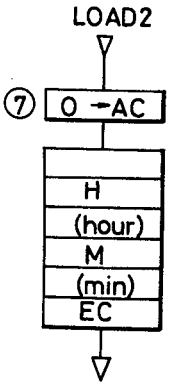

FIGS. 6(A) and 6(B) are flow charts showing the loading routine "LOAD" as depicted in step $n_1$ of FIG. 5. LOAD 1 represents the contents to be delivered as the time setting and the word codes "it's" "now", etc. and the end code (EC) are fetched from the program memory RU storing the instruction codes, while "H" and "M" information is fetched from the hours section H and minutes section M in of the alarm register AR.

$m_1$ specifies the leading address of the memory RM and $m_2$ loads sequentially the memory RM with the word codes, the time information, the melody and finally the transfer end code (EC) to complete the procedure of $n_1$ of FIG. 5. LOAD 2 is the contents to be audibly delivered with the output mode selector in the "scheduled" position. In another preferred form of the present invention, an additional message may be delivered when the alarm time setting is reached.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A timepiece capable of delivering an alarm sound or message when an alarm time setting is reached, said timepiece comprising:

an output mode selector for selecting one of at least three modes of output for said timepiece;

means for periodically delivering audible announcements of time when said timepiece is in a first of said at least three modes;

alarm time announcement means responsive to said output mode selector for delivering an audible indication of an alarm time setting in the form of synthesized voices when said timepiece is in a second of said at least three modes; and means for delivering a visual display of the alarm time setting when said timepiece is in a third of said at least three modes.

2. A timepiece as set forth in claim 1, wherein no periodic announcements of time are delivered when said timepiece is in said second mode.

3. A timepiece as set forth in claim 1 wherein said alarm message is delivered in the form of synthesized human voices.

4. A timepiece as set forth in claim 1 wherein said synthesized human voices are developed from a speech synthesizer comprising a memory containing sound-related data.

* * * * *